US009160070B2

(12) United States Patent
Carr et al.

(10) Patent No.: US 9,160,070 B2
(45) Date of Patent: Oct. 13, 2015

(54) RADIATION-HARDENED RFID TAGS

(71) Applicants: William N. Carr, Montclair, NJ (US); Prasannanasarathy Ramakrishnan, San Jose, CA (US)

(72) Inventors: William N. Carr, Montclair, NJ (US); Prasannanasarathy Ramakrishnan, San Jose, CA (US)

(73) Assignee: William N. Carr, Raleigh, NC (US)

( * ) Notice: Subject to any disclaimer, the term of this patent is extended or adjusted under 35 U.S.C. 154(b) by 65 days.

(21) Appl. No.: 13/855,566

(22) Filed: Apr. 2, 2013

(65) Prior Publication Data

US 2013/0221113 A1 Aug. 29, 2013

Related U.S. Application Data

(63) Continuation-in-part of application No. 12/706,660, filed on Feb. 16, 2010, now Pat. No. 8,477,079.

(60) Provisional application No. 61/686,156, filed on Apr. 2, 2012.

(51) Int. Cl.

| | |
|---|---|
| ***H01Q 1/52*** | (2006.01) |
| ***H01Q 1/22*** | (2006.01) |
| ***H01Q 9/04*** | (2006.01) |
| ***H01Q 9/36*** | (2006.01) |
| ***H01Q 9/42*** | (2006.01) |
| ***H01Q 23/00*** | (2006.01) |
| ***H01Q 9/16*** | (2006.01) |

(52) U.S. Cl.

CPC ..... *H01Q 1/526* (2013.01); *H01Q 1/2225* (2013.01); *H01Q 9/0414* (2013.01); *H01Q 9/16* (2013.01); *H01Q 9/36* (2013.01); *H01Q 9/42* (2013.01); *H01Q 23/00* (2013.01); *Y10T 29/49* (2015.01)

(58) Field of Classification Search

CPC ..... H01Q 1/526
USPC ..... 343/700 MS, 841
See application file for complete search history.

(56) References Cited

U.S. PATENT DOCUMENTS

| | | | | |
|---|---|---|---|---|
| 5,248,989 | A * | 9/1993 | Murdoch | 343/841 |
| 5,874,920 | A * | 2/1999 | Araki et al. | 343/702 |
| 6,469,670 | B2 * | 10/2002 | Ito | 343/702 |
| 6,759,987 | B2 * | 7/2004 | Schmidt et al. | 343/700 MS |
| 6,958,732 | B2 * | 10/2005 | Yuanzhu | 343/702 |
| 7,126,482 | B2 * | 10/2006 | Shoji et al. | 340/572.7 |
| 7,327,328 | B2 * | 2/2008 | Yoneya et al. | 343/841 |
| 8,847,842 | B2 * | 9/2014 | Zeiger et al. | 343/841 |

* cited by examiner

*Primary Examiner* — Tho G Phan
(74) *Attorney, Agent, or Firm* — Kaplan Breyer Schwarz & Ottesen

(57) ABSTRACT

RFID tags that must operate in the presence of ionizing radiation need to be radiation hardened in order to achieve reliable operation. This disclosure teaches several RFID tags that achieve radiation hardening without requiring the use of special-purpose radiation-hardened electronic devices. RFID tags typically use an antenna made of metal for achieving reliable radio communications. Radiation hardening is achieved by shaping the antenna such that the metal of the antenna acts as a shield for the radio circuits.

12 Claims, 8 Drawing Sheets

Radiation-resistant RFID tag 300 – perspective view

RFID tag 100

RFID tag 200

Radiation-resistant RFID tag 300 – perspective view

Radiation-resistant RFID tag 300 – side view

Radiation-resistant RFID tag 500 – perspective view

Radiation-resistant RFID tag 500 – side view

Radiation-resistant RFID tag with dielectric 700 – perspective view

Radiation-resistant RFID tag 800 – perspective view

Radiation-resistant RFID tag 800 – side view

Radiation-resistant RFID tag 1000 – side view

Radiation-resistant RFID tag 1100 – side view

Radiation-resistant RFID tag 1200 – side view

Radiation-resistant RFID tag 1300 – side view

Radiation-resistant RFID tag 1400 – side view

Radiation-resistant RFID tag 800 with added side shields

RADIATION-HARDENED RFID TAGS

CROSS REFERENCE TO RELATED APPLICATIONS

This case claims benefit of the following provisional application: U.S. provisional application No. 61/686,156.

This case is a Continuation-in-Part and claims priority of co-pending U.S. Ser. No. 12/706,660 titled "Multiple-Cavity Antenna" and filed on 16 Feb. 2010.

FIELD OF THE INVENTION

The present invention relates to radio-frequency identification tags, and, more particularly, to radio-frequency identification tags for use in the presence of ionizing radiation.

BACKGROUND OF THE INVENTION

Ionizing radiation—such as, for example, the radiation generated by radioactive materials, or the radiation present in planetary radiation belts—is known to cause substantial problems with electronic circuits and systems. Even relatively mild amounts of radiation cause errors in semiconductor memories. Larger amounts of radiation might even cause permanent damage to electronic devices.

RFID tags are becoming ubiquitous and useful in a variety of applications. However, in applications where exposure to ionizing radiation might occur, RFID tags suffer from the same problems as other electronic systems. This is true for all types of RFID tags. Commonly-used types of RFID technology comprise, for example, passive RFID tags without any internal source of power; semipassive RFID tags which comprise an internal battery for powering electronic circuitry and, possibly a radio receiver, but might not comprise an active radio transmitter; and active tags, which usually comprise a radio receiver and a radio transmitter, and an independent source of power such as a battery.

Passive and semipassive RFID tags make use of so-called passive-radio technology. Passive-radio technology is a particular type of radio technology wherein a radio circuit generates a radio-frequency signal from another radio-frequency signal without active amplification. In particular, for example, a passive-radio radio circuit might generate a reflection of an incoming radio-frequency signal while imparting to it a modulation based on another signal that is not a radio-frequency signal.

It is well known in the art how to make electronic systems that can tolerate ionizing radiation. Such electronic systems are referred to as "radiation-hardened". Techniques for making radiation-hardened electronic systems generally involve using electronic devices that are different from those used in standard electronic systems. For example, integrated circuits for radiation-hardened systems are fundamentally different from integrated circuits used in consumer electronics, and they can tolerate much larger amounts of ionizing radiation. Various techniques are known in the art for making such radiation-tolerant integrated circuits and other radiation-tolerant electronic devices for radiation-hardened electronic systems.

Radiation-hardened electronic systems that use radiation-tolerant electronic devices are much more expensive than equivalent systems made with general-purpose commercial devices because the radiation-tolerant devices are intrinsically more expensive and because they do not benefit from the same economies of scale as general-purpose commercial devices.

Another technique for making radiation-hardened electronic systems is to use shields. Depending on the type of ionizing radiation present, shielding can be very effective. For example, x-rays used for medical applications are very effectively blocked by metal sheets. Even relatively thin metal sheets can be sufficient to substantially attenuate such X-rays. Therefore, for an electronic system that must operate in the presence of such X-rays, for example, enclosing it in a metal sheet is an effective way to achieve some level of radiation hardening. In many applications, shielding with metal sheets can be sufficient to enable an electronic system to be made with general-purpose commercial devices instead of special-purpose radiation-tolerant devices.

Metal sheets, unfortunately, are effective for blocking not only ionizing radiation, but also radio signals. Therefore, an electronic system that comprises a radio transmitter or receiver cannot be enclosed in metal sheets because such sheets would also block the radio signal and prevent the desired functionality. This is particularly unfortunate for RFID tags, where low cost is frequently an important objective. Shielding with metal sheets is, generally, a much less expensive way of achieving radiation hardening, compared to using radiation-tolerant devices.

Another reason why it's difficult to make RFID tags with radiation-tolerant devices has to do with power consumption. Generally, radiation-tolerant electronic devices are not as power efficient as non-radiation-tolerant electronic devices. In the case of RFID tags, low power consumption is an important and difficult-to-achieve feature in general. If radiation-tolerant devices must be used, it becomes even more difficult to achieve low power consumption.

FIG. 1 shows a layout of an RFID tag 100 in accordance with the prior art. RFID tag 100 comprises metal loop 110, and radio circuit 120, arranged as shown. Typically, metal loop 110 is made out of a thin layer of metal deposited on an insulating substrate (not shown in FIG. 1) that also provides mechanical support for radio circuit 120. In RFID tag 100, metal loop 110 acts as an antenna for radio circuit 120.

If an RFID tag such as RFID tag 100 is used in an environment where ionizing radiation in present (for example, in a spacecraft) the ionizing radiation that strikes radio circuit 120 might impair its operation.

FIG. 2 shows a layout of an RFID tag 200 in accordance with the prior art. RFID tag 200 comprises metal pattern 210, and radio circuit 220, arranged as shown. Typically, metal pattern 210 is made out of a thin layer of metal deposited on an insulating substrate (not shown in FIG. 2) that also provides mechanical support for radio circuit 220. In RFID tag 200, metal pattern 210 acts as an antenna for radio circuit 220.

If an RFID tag such as RFID tag 200 is used in an environment where ionizing radiation in present (for example, in a spacecraft) the ionizing radiation that strikes radio circuit 220 might impair its operation.

SUMMARY OF THE INVENTION

The RFID tags shown in FIGS. 1 and 2 use antennas (metal loop 110 and metal pattern 120) that are representative of antennas commonly used for RFID tags in the prior art. However, other antenna designs for RFID tags exist. In particular, U.S. Pat. Nos. 8,284,104 B2, 8,384,599, and U.S. patent application Ser. No. 12/706,660 disclose several antenna designs suitable for RFID tags. Many of such antenna designs can be realized with one or more metal sheets.

One aspect of RFID technology is that the radio circuit used in an RFID tag is typically very small, and, indeed, it is typically much smaller than the antenna. In the other antenna designs mentioned in the previous paragraphs, the radio circuit is referred to as a "load element". When such designs are realized with metal sheets, the radio circuit is typically located very near one or more of the metal sheets, and is frequently partially surrounded by metal sheets.

Because metal sheets can make effective shields, the radio circuit in such designs is partially shielded from ionizing radiation by the antenna itself. Embodiments of the present invention comprise antenna designs that can be realized with metal sheets and that are deliberately designed to enclose the radio circuit, either partially or totally, so as to achieve a substantial reduction in the level of ionizing radiation that strikes the radio circuits. In many practical applications, embodiments of the present invention shield the radio circuit from a portion of the ionizing radiation substantial enough to allow the use of non-radiation-tolerant electronic devices.

For an RFID tag to provide its intended functionality, the antenna must generate a radio signal, when used as a transmitting antenna, efficiently and with an antenna pattern that has a good spatial distribution. The same criteria apply when the antenna is used by the RFID tag as a receiving antenna. These criteria make it difficult to achieve antenna designs wherein all ionizing radiation is intercepted, by metal sheets that are part of the antenna, regardless of the direction from which the ionizing radiation arrives; indeed, in some of the antenna designs disclosed herein, there are some directions from which ionizing radiation might reach the radio circuit without first encountering a metal sheet. Even though such designs do block ionizing radiation arriving from most directions, there are RFID applications where it is desirable that ionizing radiation arriving from all possible directions be intercepted by, at least, one metal sheet.

To achieve such complete interception of all directions of arrival, some embodiments of the present invention comprise additional metal sheets that are not part of the design of the antenna. While not part of the design of the antenna, these additional metal sheets have the potential to disrupt the normal operation of the antenna—for example, by changing the impedance of the antenna—and to severely alter the antenna pattern. In embodiments of the present invention that comprise additional metal sheets, the antenna is designed such that the additional metal sheets can be arranged, relative to the antenna, such that the functionality of the antenna is not substantially impaired. In particular, neither the impedance, nor other operational parameters of the antenna, nor the antenna pattern are substantially impaired by the presence of the additional metal sheets.

BRIEF DESCRIPTION OF THE DRAWINGS

In FIG. 4, the RFID tag is viewed from a different point of view.

DETAILED DESCRIPTION

Figure 1:
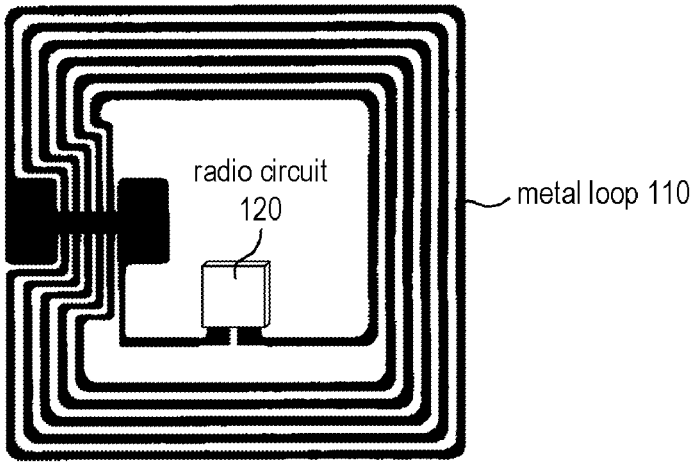
FIG. 1 PRIOR ART
FIG. 1 shows a layout of an RFID tag in accordance with the prior art.
Figure 2:
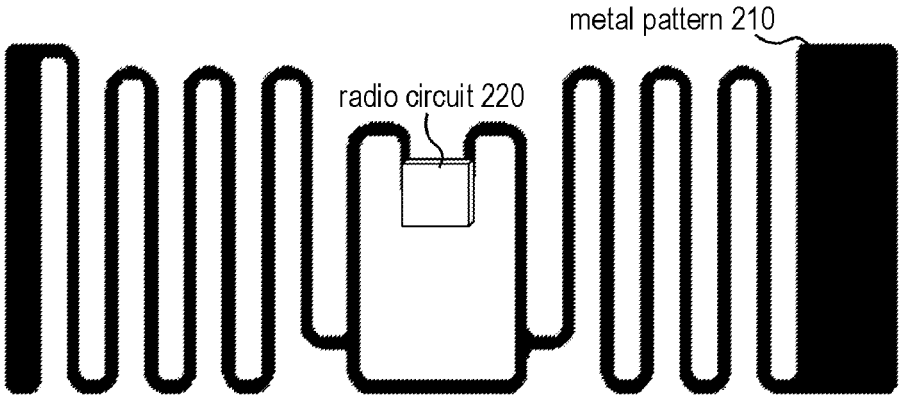
FIG. 2 PRIOR ART
FIG. 2 shows a layout of another RFID tag in accordance with the prior art.
Figure 3:
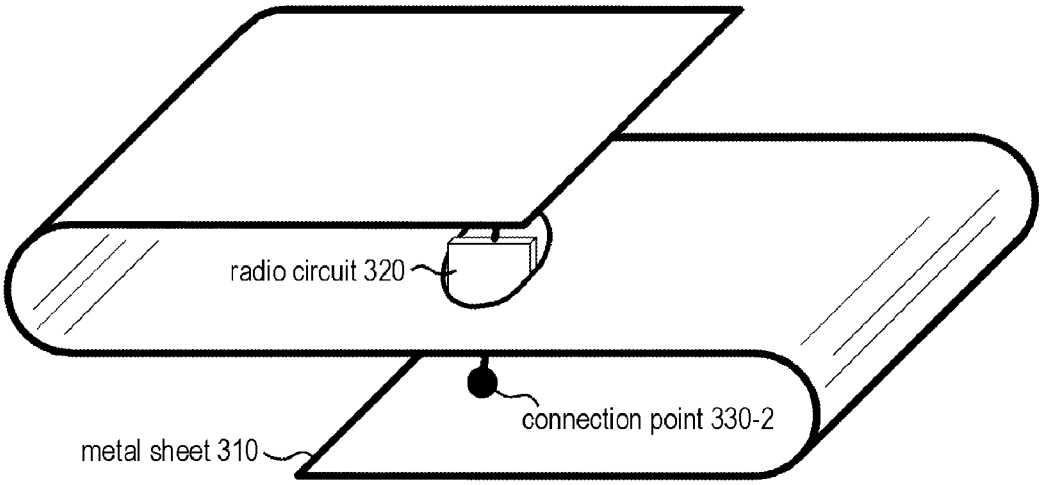
FIG. 3 depicts a radiation-resistant RFID tag in accordance with a first illustrative embodiment of the present invention.

FIG. 3 depicts radiation-resistant RFID tag 300 in accordance with a first illustrative embodiment of the present invention. FIG. 3 depicts a perspective view. Radiation-resistant RFID tag 300 comprises: metal sheet 310 and radio circuit 320, arranged and interrelated as shown.

Metal sheet 310 is bent in a shape that resembles a letter "S". It is a shape that forms an effective antenna when connected to radio circuit 320 as shown.

Figure 4:
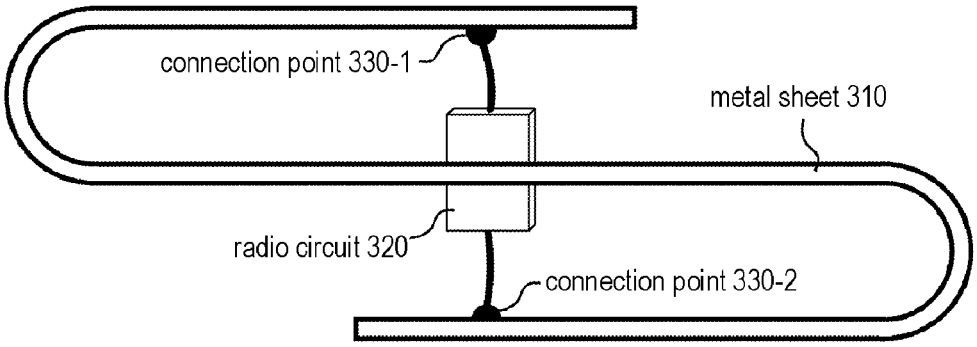
FIG. 4 is an alternative depiction of the radiation-resistant RFID tag depicted in FIG. 3.

FIG. 4 depicts an alternative view of radiation-resistant RFID tag 300 in accordance with the first illustrative embodiment of the present invention. FIG. 4 depicts a side view, wherein the "S" shape of metal sheet 310 is clearly visible.

Radio circuit 320 is electrically connected to the antenna formed by metal sheet 310 at connection points 330-1 and 330-2. Together, the two connection points form the input-output port of the antenna formed by metal sheet 310.

The geometry of metal sheet 310, relative to radio circuit 320, is such that radio circuit 320 is protected, at least partially, from ionizing radiation that might be present in the environment. For example, in an environment where particles of ionizing radiation come from all possible directions, a large fraction of the particles that strike radio circuit 320 must pass through metal sheet 310. If metal sheet 310 is sufficiently thick, many of those particles will be absorbed, or deflected, or attenuated, or a combination thereof.

In environments where particles of ionizing radiation come, preferentially, from certain directions, RFID tag 300 can be oriented such that particles that come from those directions must pass through metal sheet 310. If it is not possible to orient the RFID tag in such an advantageous orientation; for example, if the orientation has to be random, there is a high statistical probability that the random orientation is one that makes the particles of ionizing radiation pass through metal sheet 310.

In the side view of FIG. 4, the thickness of metal sheet 310 is clearly visible. The thickness that the sheet needs to have in order to provide shielding from a substantial portion of the ionizing radiation depends on several factors; among them, some important factors are: (i) the type and energy of the ionizing radiation; (ii) the distribution of directions from which the ionizing radiation arrives; (iii) the specific metal used for the metal sheet; (iv) the intensity of the ionizing radiation; and (v) the sensitivity of the radio circuit to the ionizing radiation. In some embodiments of the present invention, metal sheet 310 might be very thick. It will be clear to those skilled in the art, after reading this disclosure, how to make and use embodiments of the present invention wherein metal sheet 310 has a thickness that provides a desired amount of shielding.

Most metals are effective at providing some shielding from ionizing radiation. Similarly, most metals are good electrical conductors. However, some metals are better than others at providing shielding, and some metals are better electrical conductors than others. For making good antennas, metals that are good electrical conductors are best. Unfortunately, metals that are best at providing shielding are not necessarily the best electrical conductors, and vice versa. For example, copper is an excellent electrical conductor, but its effectiveness at shielding is not as good as it is for lead. Lead, in turn, is excellent for shielding, but it is not a very good electrical conductor.

In many embodiments of the present invention, the shielding provided by copper might be sufficient. In such embodiments, metal sheet 310 could be advantageously made out of copper. In other embodiments wherein good shielding is important, but optimal antenna performance is not essential, metal sheet 310 might be made out of lead. In embodiments where both good shielding and optimal antenna performance are desired, metal sheet 310 might be made out of two—or even more than two—metals. For example, metal sheet 310 might be made out of lead coated with copper. Such a layered composition is effective because good antennas require a material with good electrical conductivity only near the surface. Good shielding, in contrast, depends on the properties of the bulk material. A sheet made mostly of lead, but with a thin coating of copper, is as effective as an all-lead sheet for shielding, and as effective as an all copper sheet for making a good antenna. It will be clear to those skilled in the art, after reading this disclosure, how to make and use embodiments of the present invention wherein metal sheet 310 is made out of a plurality of metal layers, and it will be clear to those skilled in the art how thick to make each layer to achieve a desired shielding effectiveness and a desired antenna performance.

Figure 5:
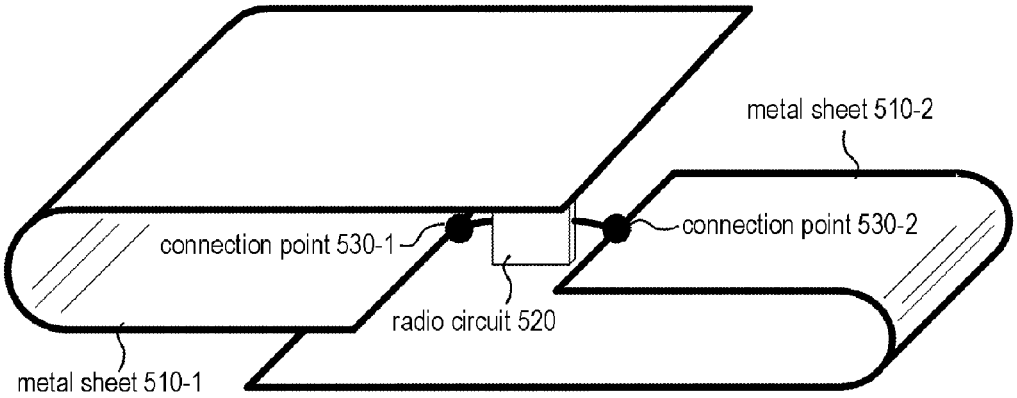
FIG. 5 depicts a radiation-resistant RFID tag in accordance with a second illustrative embodiment of the present invention.

FIG. 5 depicts radiation-resistant RFID tag 500 in accordance with a second illustrative embodiment of the present invention. FIG. 5 depicts a perspective view. Radiation-resistant RFID tag 500 comprises: metal sheets 510-1 and 510-2, and radio circuit 520, arranged and interrelated as shown.

Metal sheets 510-1 and 510-2 are bent such that, together with radio circuit 520, they form a shape that resembles a letter "S". It is a shape that forms an effective antenna when connected to radio circuit 520 in the middle of the "S" shape, as shown.

Figure 6:
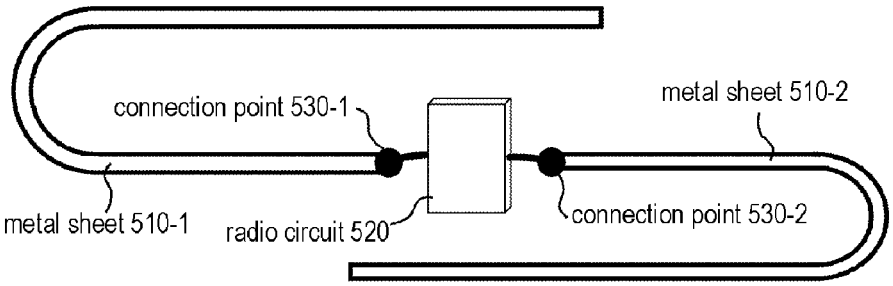
FIG. 6 depicts an alternative view of the radiation-resistant RFID tag in accordance with the second illustrative embodiment of the present invention that was depicted by FIG. 5.

FIG. 6 depicts an alternative view of radiation-resistant RFID tag 500 in accordance with the second illustrative embodiment of the present invention. FIG. 6 depicts a side view, wherein the "5" shape of metal sheets 510-1 and 510-2, as connected to radio circuit 520 is clearly visible.

Radio circuit 520 is electrically connected to the antenna formed by metal sheets 510-1 and 510-2 at connection points 530-1 and 530-2. Together, the two connection points form the input-output port of the antenna formed by metal sheets 510-1 and 510-2.

The geometry of metal sheets 510-1 and 510-2, relative to radio circuit 520, is such that radio circuit 520 is protected, at least partially, from ionizing radiation that might be present in the environment. The comments that were made for radiation-resistant RFID tag 300 also apply to radiation-resistant tag 500.

FIGS. 5 and 6 depict radiation-resistant RFID tag 500 as having a group of two metal sheets, i.e., metal sheets 510-1 and 510-2, that are part of the antenna. The shape, size, relative position, and other characteristics of the two metal sheets are such that a desired antenna pattern and desired antenna performance are achieved. Although the figure shows a group of two sheets, it will be clear to those skilled in the art, after reading this disclosure, how to make and use embodiments of the present invention wherein a group of metal sheets that are part of the antenna comprises a different number of metal sheets, not less than one, arranged, relative to the radio circuit, such that the radio circuit is shielded from a substantial portion of the ionizing radiation. For example, the radio circuit might be shielded from at least 90% of ionizing radiation.

Figure 7:
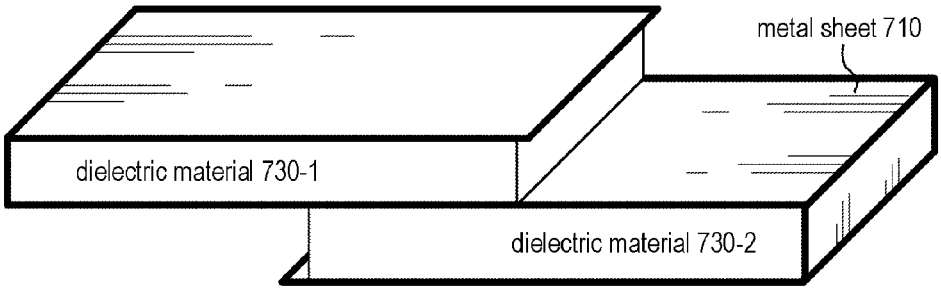
FIG. 7 depicts a radiation-resistant RFID tag in accordance with a third illustrative embodiment of the present invention.

FIG. 7 depicts radiation-resistant RFID tag 700 in accordance with a third illustrative embodiment of the present invention. FIG. 7 depicts a perspective view. Radiation-resistant RFID tag 700 comprises: metal sheet 710, bent in a shape that resembles a letter "S" with sharp corners, and dielectric materials 730-1 and 730-2 filling the space between sections of metal sheet 710, as shown.

Radiation-resistant RFID tag 700 has a geometry equivalent to the geometry of radiation-resistant tag 300 and, like radiation-resistant tag 300, it has a radio circuit connected to an input-output port in a manner similar to how radio circuit 320 is connected to the antenna in radiation-resistant tag 300. The input-output port and the radio circuit in radiation-resistant tag 700 are not visible in FIG. 7 because they are embedded in dielectric materials 730-1 and 730-2.

In FIGS. 3, 4, 5, and 6, the elements of the RFID tags are depicted as suspended in mid air. In practice, embodiments of the present inventions in accordance with the RFID tags depicted in those figures will have support elements for keeping the elements in the appropriate geometry. Such support elements are not shown in those figures, and in other figures in this disclosure, to avoid confusing clutter in the images. In some embodiments of the present invention, the use of a dielectric material might be advantageous for achieving desired antenna characteristics. A dielectric is not shown in most figures in this disclosure for the same reason why support elements are not shown. FIG. 7 is intended to depict how such dielectric material might be used with an antenna structure similar to that of radiation-resistant RFID tag 300. In FIG. 7, the dielectric material is used to achieve desired antenna characteristics and also for mechanical support of the structure of radiation-resistant RFID tag 700.

Most dielectric materials do not provide effective shielding from ionizing radiation, but some dielectric materials do exist that are effective shields. For example materials such as bismuth germanate (BGO) and Cerium-doped Lutetium Yttrium Orthosilicate (LYSO) are dielectric materials that are also effective at shielding from some types of ionizing radiation. The use of such dielectric materials in embodiments of the present invention that use dielectric materials can provide additional shielding of the radio circuit from ionizing radiation.

Figure 8:
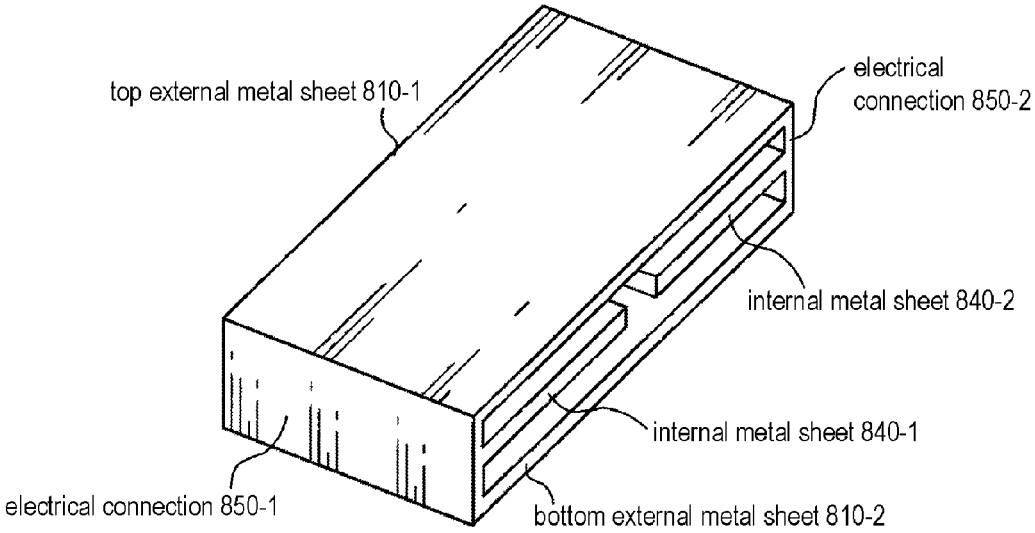
FIG. 8 depicts a radiation-resistant RFID tag in accordance with a fourth illustrative embodiment of the present invention.

FIG. 8 depicts radiation-resistant RFID tag 800 in accordance with a fourth illustrative embodiment of the present invention. FIG. 8 depicts a perspective view. Radiation-resistant RFID tag 800 comprises: top external metal sheet 810-1, bottom external metal sheet 810-2, internal metal sheets 840-1 and 840-2, and electrical connections 850-1 and 850-2, arranged and interrelated as shown.

Top external metal sheet 810-1 and bottom external metal sheet 810-2 both have the same rectangular shape and are arranged parallel to and aligned with one another. Internal metal sheet 840-1 and internal metal sheet 840-2 are parallel to and between top external metal sheet 810-1 and bottom external metal sheet 810-2. Electrical connection 850-1 connects together: an edge of top external metal sheet 810-1, the corresponding edge of bottom metal sheet 810-2, and an edge of internal metal sheet 840-1. Electrical connection 850-2 connects together: an edge of top external metal sheet 810-1 opposite electrical connection 850-1, the corresponding edge of bottom metal sheet 810-2, and an edge of internal metal sheet 840-2. Top external metal sheet 810-1, bottom external metal sheet 810-2, together with electrical connections 850-1 and 850-2 form a rectangular box. The remaining two metal sheets—namely, internal metal sheets 840-1 and 840-2—are inside the box. Radiation-resistant RFID tag 800 also comprises a radio circuit that is not visible in FIG. 8, because it is inside the box, but is visible in FIG. 9.

Figure 9:
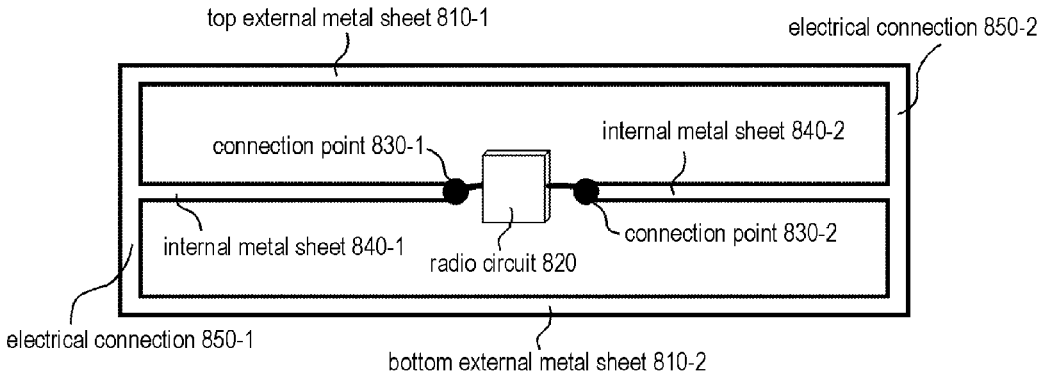
FIG. 9 depicts an alternative view of the radiation-resistant RFID tag in accordance with the fourth illustrative embodiment of the present invention that was depicted by FIG. 8.

FIG. 9 depicts an alternative view of radiation-resistant RFID tag 800 in accordance with the fourth illustrative embodiment of the present invention. FIG. 9 depicts a side view, wherein the rectangular outline of the box formed by top external metal sheet 810-1, bottom external metal sheet 810-2, and electrical connections 850-1 and 850-2 is clearly visible. Internal metal sheets 840-1 and 840-2 are also clearly visible. The Figure also shows that radiation-resistant RFID tag 800 further comprises radio circuit 820, which is electrically connected to the antenna formed by the four metal sheets and the two electrical connections at connection points 830-1 and 830-2. Together, the two connection points form the input-output port of the antenna formed by the four metal sheets and the two electrical connections.

In this illustrative embodiment, electrical connections 850-1 and 850-2 are implemented with two short metal sheets having the same thickness as top external metal sheet 810-1 and bottom external metal sheet 810-2. However, it will be clear to those skilled in the art, after reading this disclosure, how to make and use embodiments of the present invention wherein electrical connections 850-1 and 850-2 are implemented differently. For example, and without limitation, the two electrical connections might be implemented with metal sheets of different widths and thicknesses, with metal wires, or with other types of electrical connections well known in the art.

In this illustrative embodiment, internal metal sheets 840-1 and 840-2 have the same thickness as top external metal sheet 810-1 and bottom external metal sheet 810-2. However, radio circuit 820 is shielded from ionizing radiation primarily by top external metal sheet 810-1 and bottom external metal sheet 810-2. The two internal metal sheets do not provide much shielding. Accordingly, it will be clear to those skilled in the art, after reading this disclosure, how to make and use embodiments of the present invention wherein internal sheets 840-1 and 840-2 do not have the same thickness as top external metal sheet 810-1 and bottom external metal sheet 810-2.

The geometry of top external metal sheet 810-1 and bottom external metal sheet 810-2, relative to radio circuit 820, is such that radio circuit 820 is protected, at least partially, from ionizing radiation that might be present in the environment. The comments that were made for radiation-resistant RFID tag 300 also apply to radiation-resistant tag 800.

Figure 10:
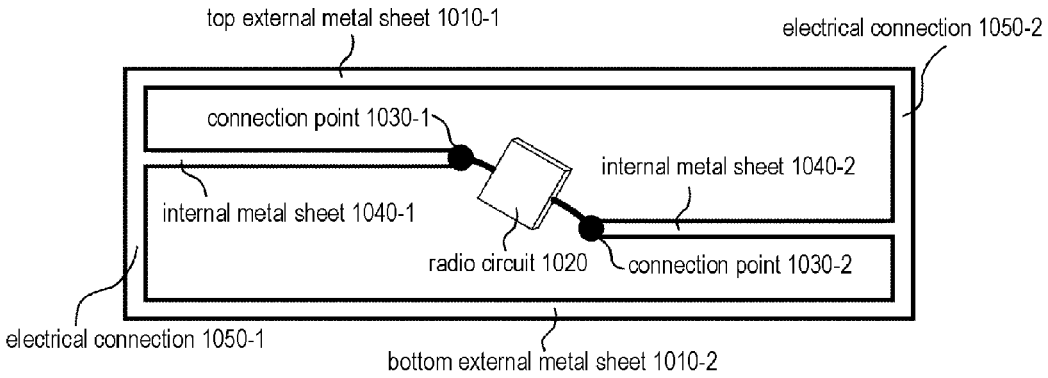
FIG. 10 depicts a radiation-resistant RFID tag in accordance with a fifth illustrative embodiment of the present invention.

FIG. 10 depicts radiation-resistant RFID tag 1000 in accordance with a fifth illustrative embodiment of the present invention. FIG. 10 depicts a side view. The external shape of radiation-resistant RFID tag 1000 is a rectangular box similar to radiation-resistant RFID tag 800. Radiation-resistant RFID tag 1000 comprises: top external metal sheet 1010-1, bottom external metal sheet 1010-2, internal metal sheets 1040-1 and 1040-2, electrical connections 1050-1 and 1050-2, and radio circuit 1020, arranged and interrelated as shown.

Radio circuit 1020 is electrically connected to the antenna formed by the metal sheets and electrical connections at connection points 1030-1 and 1030-2. Together, the two connection points form the input-output port of the antenna formed by the metal sheets and electrical connections.

The geometry of metal sheets and electrical connections, relative to radio circuit 1020, is such that radio circuit 1020 is protected, at least partially, from ionizing radiation that might be present in the environment. The comments that were made for radiation-resistant RFID tag 300 and for radio-resistant RFID tag 800 also apply to radiation-resistant tag 1000. Radiation-resistant RFID tag 1000 differs from radiation-resistant RFID tag 800 in that internal metal sheets 1040-1 and 1040-2 are not in the same plane.

Figure 11:
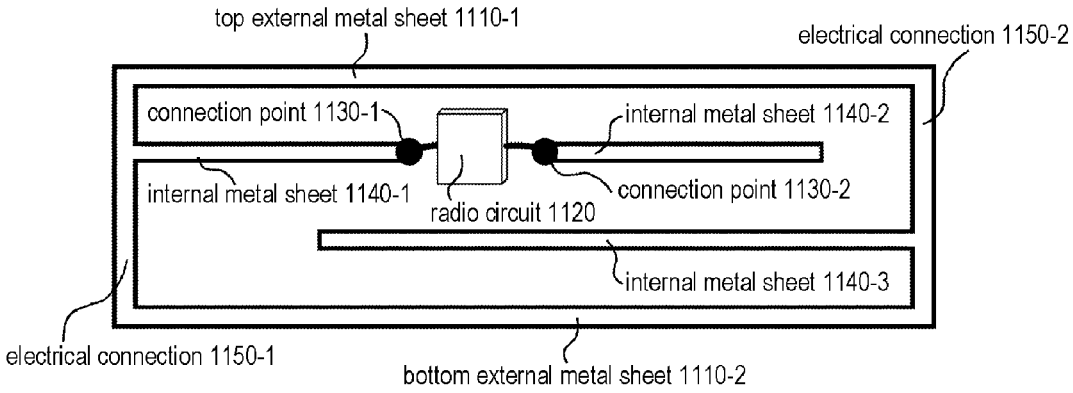
FIG. 11 depicts a radiation-resistant RFID tag in accordance with a sixth illustrative embodiment of the present invention.

FIG. 11 depicts radiation-resistant RFID tag 1100 in accordance with a sixth illustrative embodiment of the present invention. FIG. 11 depicts a side view. The external shape of radiation-resistant RFID tag 1100 is a rectangular box similar to radiation-resistant RFID tag 800. Radiation-resistant RFID tag 1100 comprises: top external metal sheet 1110-1, bottom external metal sheet 1110-2, internal metal sheets 1140-1, 1140-2, and 1140-3, electrical connections 1150-1 and 1150-2, and radio circuit 1120, arranged and interrelated as shown.

Radio circuit 1120 is electrically connected to the antenna formed by the metal sheets and electrical connections at connection points 1130-1 and 1130-2. Together, the two connection points form the input-output port of the antenna formed by the metal sheets and electrical connections.

The geometry of metal sheets and electrical connections, relative to radio circuit 1120, is such that radio circuit 1120 is protected, at least partially, from ionizing radiation that might be present in the environment. The comments that were made for radiation-resistant RFID tag 300 and for radio-resistant RFID tag 800 also apply to radiation-resistant tag 1100.

Figure 12:
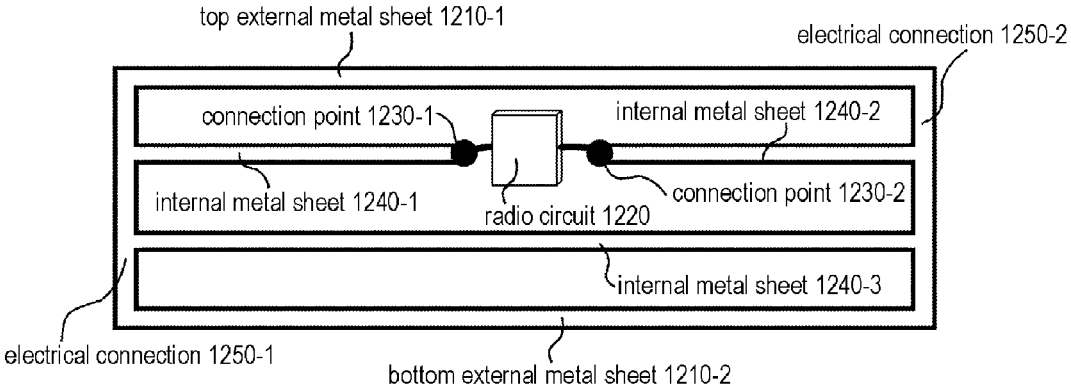
FIG. 12 depicts a radiation-resistant RFID tag in accordance with a seventh illustrative embodiment of the present invention.

FIG. 12 depicts radiation-resistant RFID tag 1200 in accordance with a seventh illustrative embodiment of the present invention. FIG. 12 depicts a side view. The external shape of radiation-resistant RFID tag 1200 is a rectangular box similar to radiation-resistant RFID tag 800. Radiation-resistant RFID tag 1200 comprises: top external metal sheet 1210-1, bottom external metal sheet 1210-2, internal metal sheets 1240-1, 1240-2, and 1240-3, electrical connections 1250-1 and 1250-2, and radio circuit 1220, arranged and interrelated as shown.

Radio circuit 1220 is electrically connected to the antenna formed by the metal sheets and electrical connections at connection points 1230-1 and 1230-2. Together, the two connection points form the input-output port of the antenna formed by the metal sheets and electrical connections.

The geometry of metal sheets and electrical connections, relative to radio circuit 1220, is such that radio circuit 1220 is protected, at least partially, from ionizing radiation that might be present in the environment. The comments that were made for radiation-resistant RFID tag 300 and for radio-resistant RFID tag 800 also apply to radiation-resistant tag 1200.

Figure 13:
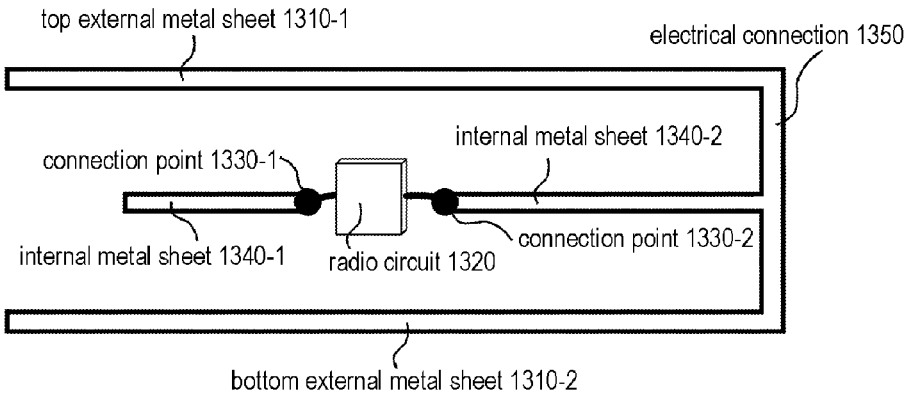
FIG. 13 depicts a radiation-resistant RFID tag in accordance with an eighth illustrative embodiment of the present invention.

FIG. 13 depicts radiation-resistant RFID tag 1300 in accordance with an eighth illustrative embodiment of the present invention. FIG. 13 depicts a side view. The external shape of radiation-resistant RFID tag 1300 is a rectangular box similar to radiation-resistant RFID tag 800. Radiation-resistant RFID tag 1300 comprises: top external metal sheet 1310-1, bottom external metal sheet 1310-2, internal metal sheets 1340-1 and 1340-3, electrical connection 1350, and radio circuit 1320, arranged and interrelated as shown.

Radio circuit 1320 is electrically connected to the antenna formed by the metal sheets and the electrical connection at connection points 1330-1 and 1330-2. Together, the two connection points form the input-output port of the antenna formed by the metal sheets and electrical connections.

The geometry of metal sheets and the electrical connection, relative to radio circuit 1320, is such that radio circuit 1320 is protected, at least partially, from ionizing radiation that might be present in the environment. The comments that were made for radiation-resistant RFID tag 300 and for radio-resistant RFID tag 800 also apply to radiation-resistant tag 1300.

Figure 14:
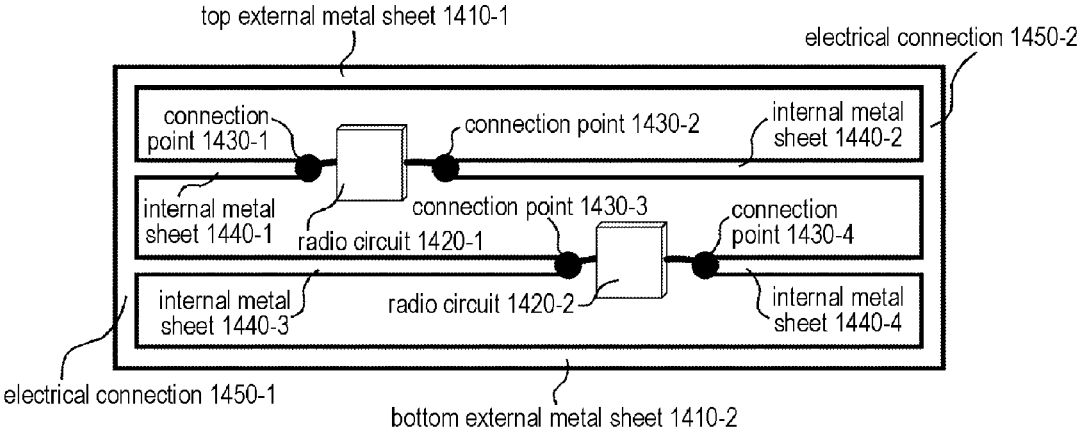
FIG. 14 depicts a radiation-resistant RFID tag in accordance with a ninth illustrative embodiment of the present invention.

FIG. 14 depicts radiation-resistant RFID tag 1400 in accordance with a ninth illustrative embodiment of the present invention. FIG. 14 depicts a side view. The external shape of radiation-resistant RFID tag 1400 is a rectangular box similar to radiation-resistant RFID tag 800. Radiation-resistant RFID tag 1400 comprises: top external metal sheet 1410-1, bottom external metal sheet 1410-2, internal metal sheets 1440-1, 1440-2, 1440-3, and 1440-4, electrical connections 1450-1 and 1450-2, and radio circuits 1420-1 and 1420-2, arranged and interrelated as shown.

Radio circuit 1420-1 is electrically connected to the antenna formed by the metal sheets and electrical connections at connection points 1430-1 and 1430-2. Together, the two connection points form one input-output port of the antenna formed by the metal sheets and electrical connections. Radio circuit 1420-2 is electrically connected to the antenna formed by the metal sheets and electrical connections at connection points 1430-3 and 1430-4. Together, the two connection points form another input-output port of the antenna formed by the metal sheets and electrical connections.

The geometry of metal sheets and electrical connections, relative to radio circuits 1420-1 and 1420-2, is such that radio circuits 1420-1 and 1420-2 are protected, at least partially, from ionizing radiation that might be present in the environment. The comments that were made for radiation-resistant RFID tag 300 and for radio-resistant RFID tag 800 also apply to radiation-resistant tag 1400.

Radiation-resistant RFID tag 1400 is an example of an RFID tag with more than one radio circuit, utilizing an antenna with more than one input-output port.

Figure 15:
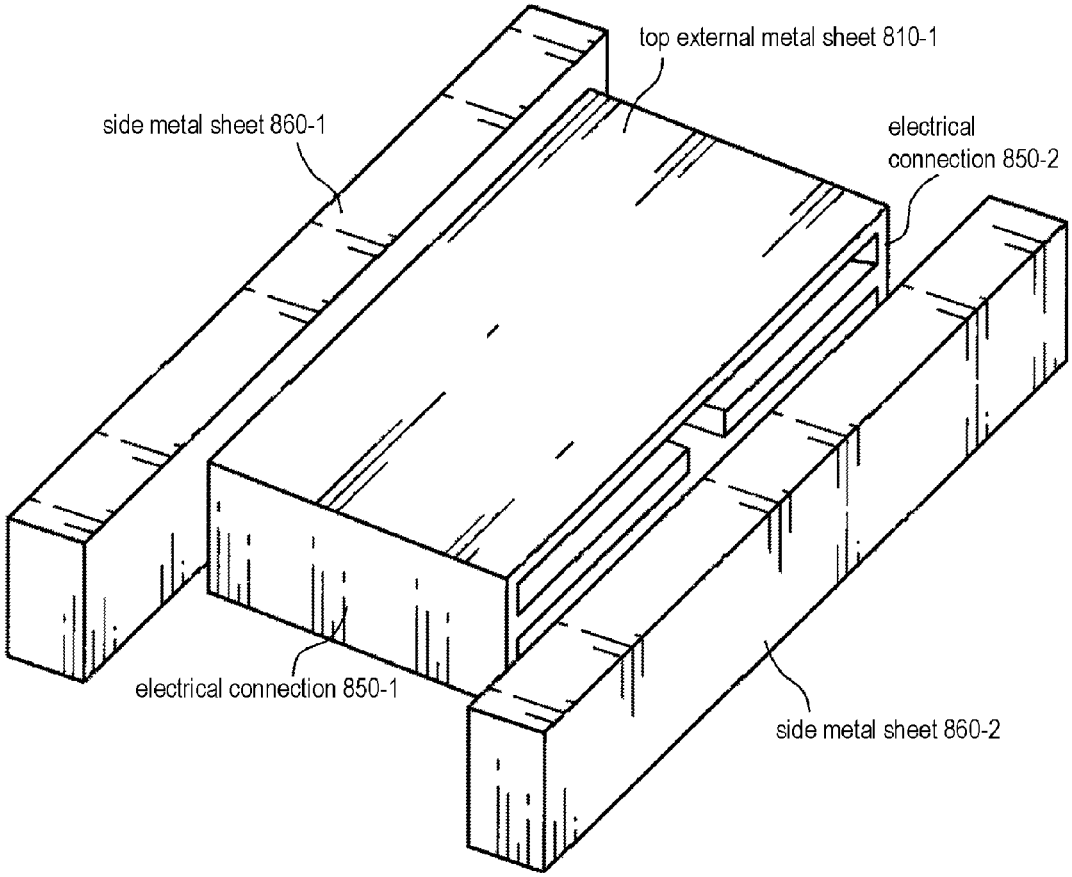
FIG. 15 depicts a radiation-resistant RFID tag with added side shields in accordance with a tenth illustrative embodiment of the present invention.

FIG. 15 depicts radiation-resistant RFID tag 800 with added side shields in accordance with a tenth illustrative embodiment of the present invention. FIG. 14 depicts a side view. This embodiment comprises radiation-resistant RFID tag 800 and side metal sheets 860-1 and 860-2, arranged and interrelated as shown.

The purpose of side metal sheets 860-1 and 860-2 is to act as side shields for blocking ionizing radiation that might reach radio circuit 820 through the openings in the sides of the rectangular box. As such, the side metal sheets do not contribute to the functionality of the antenna; indeed, they have the potential to disrupt the normal operation of the antenna—for example, by changing the impedance of the antenna—and to severely alter the antenna pattern.

In this embodiment of the present invention, the antenna is designed to have narrow openings in the sides of the rectangular box. Therefore, side metal sheets 860-1 and 860-2 can be narrow and still provide the desired shielding of radio circuit 820. It will be clear to those skilled in the art, after reading this disclosure, how to make and use embodiments of the present invention wherein side shields 860-1 and 860-2 are sufficiently far from the rectangular box of radiation-resistant RFID tag 800 so that disruptions of the normal operation of the antenna—such as changes in antenna impedance, antenna pattern, or other operational parameters of the antenna—are tolerable, and so that the functionality of the antenna is not substantially impaired.

FIG. 15 depicts a group of two added metal sheets, i.e., metal sheets 860-1 and 860-2, that are not part of the antenna. The shape, size, relative position with respect to the antenna, and other characteristics of the two metal sheets are such the functionality of the antenna is not substantially impaired.

Although FIG. 15 shows a group of two sheets, it will be clear to those skilled in the art, after reading this disclosure, how to make and use embodiments of the present invention wherein such a group of metal sheets, that are not part of the antenna, comprises a different number of metal sheets, not less than one, arranged, relative to the antenna, such that an additional portion of the ionizing radiation, not blocked by metal sheets in the antenna, is blocked. For example, such an additional portion might be half, or 80%, or 90% of the ionizing radiation not blocked by metal sheets in the antenna.

It is to be understood that this disclosure teaches just one or more examples of one or more illustrative embodiments, and that many variations of the invention can easily be devised by those skilled in the art after reading this disclosure, and that the scope of the present invention is to be determined by the claims accompanying this disclosure.

Markman Definitions

Antenna—For the purposes of this patent application, an "antenna" is defined as a device for converting an electrical radio-frequency signal into a radio signal, or vice versa, or both. Typically, an antenna is made out of one or more pieces of metal suitably sized shaped and arranged. Antennas might also comprise dielectric materials, in addition to metal. Conductive materials other than metals are sometimes used.

Antennas are, intrinsically, reciprocal devices: a "transmitting" antenna can be used as a "receiving" antenna for the same type of radio signals that it can transmit. The adjectives "transmitting" and "receiving" are commonly used in the art to identify how an antenna is being used, but they do not imply a physical or electrical specialization of the antenna for either function.

A simple antenna has a single input-output port (sometimes implemented with a radio-frequency connector). Such an antenna, when used for transmission, accepts a radio-frequency signal at its input-output port and transmits a radio signal derived from the radio-frequency signal. The same antenna, when used for reception, receives a radio signal and generates, at the input-output port, a radio-frequency signal derived from the radio signal. More complex antennas might have multiple input-output ports and be capable of transmitting and/or receiving multiple radio signals. Antennas can simultaneously receive and transmit radio signals.

Antenna pattern—For the purposes of this patent application, "antenna pattern" should be given the ordinary and customary meaning understood by those skilled in the art. In particular, "antenna pattern" is the pattern of transmission of radio signals by an antenna, when used as a transmitting antenna, relative to the geometrical structure of the antenna. Because antennas are reciprocal devices, antenna pattern for transmission is identical to antenna pattern for reception.

Note: antenna pattern is frequently referred to in the art as "antenna radiation pattern", wherein "radiation" is understood to mean "electromagnetic radiation", i.e., electromagnetic waves of the type radiated by antennas. In this patent application, in order to avoid confusion, the word "radiation" is used exclusively to mean "ionizing radiation". The words "radio signal" are used to refer to electromagnetic waves of the type radiated by antennas.

Based on—For the purposes of this patent application, the phrase "based on" is defined as "being dependent on" in contrast to "being independent of". Being "based on" includes both functions and relations.

Note: For the purposes of this definition of "bimetallic" the word "metal" should be interpreted broadly to refer to any electrically conductive material that can be used to form a junction with another such material such that the junction develops non-linearity in response to corrosion.

Dielectric—In this patent application, the word "dielectric" is used both as a noun and as an adjective to refer to a material that is electrically insulating (adjective) or an electrical insulator (noun).

To Exhibit—For the purposes of this patent application, the infinitive "to exhibit" and its inflected forms (e.g., "exhibiting", "exhibits", etc.) is defined as "to manifest or make evident".

To Generate—For the purposes of this patent application, the infinitive "to generate" and its inflected forms (e.g., "generating", "generation", etc.) should be given the ordinary and customary meaning that the terms would have to a person of ordinary skill in the art at the time of the invention.

Group—The American Heritage Dictionary, third edition, provides several definitions for the noun "group". One of them is: "A class or collection of related objects or entities". For the purposes of this patent application, this definition is somewhat broadened to mean a collection of one or more objects or entities without implying per se any particular relationship between the objects or entities. Note: a group can comprise as few as just one object or entity.

Radio circuit—For the purposes of this patent application, a "radio circuit" is defined as an electronic circuit for processing a radio-frequency signal. For example, a radio circuit might be used for generating a radio-frequency signal, or for accepting a radio-frequency signal, or both. A radio circuit might generate more than one radio-frequency signal, or might accept more than one radio-frequency signal, or both.

Radio communicator—For the purposes of this patent application, a "radio communicator" is defined as an apparatus for communicating through the use of radio signals. A radio communicator might be a radio transmitter, or a radio receiver, or a radio transceiver.

Radio-frequency—For the purposes of this patent application, the hyphenated group "radio-frequency" is used exclusively as an adjective to denote something that has to do with radio signals but is not, itself, a radio signal. This definition is somewhat narrower than the use of "radio-frequency" in the art, where it is sometimes used as a noun to refer to an actual radio signal.

Radio-frequency Identification (abbreviated as: RFID)—This expression is commonly used in the art to refer to a technique for tracking objects and/or storing and retrieving information about objects wirelessly by means of radio signals. The technique is typically implemented through the use of radio communicators that are attached to the objects and are known as RFID tags.

Radio-frequency signal—For the purposes of this patent application, a "radio-frequency signal" is defined as a signal that is representative of a radio signal, but that is supported by a material medium. For example, when an antenna receives a radio signal, it generates an electrical signal at its input-output port that is derived from the received radio signal. The input-output port of the antenna might be a connector made of metal. The electrical signal is supported by the metal of the connector. The electrical signal is, according to this definition, a radio-frequency signal. Similarly, a radio transmitter generates a radio signal by first generating an electrical radio-frequency signal that is fed to an antenna which generates a radio signal derived from the radio-frequency signal. Material media that support radio-frequency signals comprise conductive materials, such as metals, and dielectric materials. Such materials are used, for example, in transmission lines that carry radio-frequency signals over distances.

Radio receiver—For the purposes of this patent application, a "radio receiver" is defined as an apparatus for receiving a radio signal. Typically, a radio receiver comprises an antenna for converting the radio signal into a radio-frequency signal, and a radio circuit for processing the radio-frequency signal. A radio receiver might be capable of receiving more than one radio signal.

Radio signal—For the purposes of this patent application, a "radio signal" is defined as a signal consisting of an electromagnetic wave that propagates through air or vacuum without needing a material support such as a wire, a connector, or a transmission line.

Radio transceiver—For the purposes of this patent application, a "radio transceiver" is defined as an apparatus that comprises both a radio transmitter and a radio receiver. A radio transceiver might have separate radio circuits for implementing the radio receiver and the radio transmitter, or it might have a radio circuit that implements both a radio receiver and a radio transmitter, either simultaneously or at different times.

Radio transmitter—For the purposes of this patent application, a "radio transmitter" is defined as an apparatus for transmitting a radio signal. Typically, a radio transmitter comprises a radio circuit for generating a radio-frequency signal, and an antenna for converting the radio-frequency signal into the radio signal. A radio transmitter might be capable of transmitting than one radio signal.

To Receive—For the purposes of this patent application, the infinitive "to receive" and its inflected forms (e.g., "receiver", "receiving", "received", "reception", etc.) should be given the ordinary and customary meaning that the terms would have to a person of ordinary skill in the art at the time of the invention. In this patent application, the preposition "over" is used to indicate reception from a supporting medium or channel, as in "receiving over a network". In contrast, the preposition "through" is used to indicate transmission by means of a supporting medium or channel, as in "transmitting through a network". The reason for using different prepositions is to enhance clarity. Reception of a radio-frequency signal requires a material medium as in reception over a transmission line or over an electrical connection. Reception of a radio signal over a radio channel occurs over air or vacuum and is accomplished with the use of an antenna.

Sheet—The American Heritage Dictionary, third edition, provides several definitions for the noun "sheet". One of them is: "A broad, thin, usually rectangular mass or piece of material, . . . ". This is the definition to be used for the purposes of this patent application; however, the noun should be understood to comprise nonrectangular shapes. Also, the thickness of a "sheet" should be understood to be what is necessary to achieve a level of blocking of ionizing radiation as needed for a specific application, even though such thickness might not be regarded as "thin" in a different context.

Substantial—The American Heritage Dictionary, third edition, provides several definitions for the adjective "substantial". One of them is: "Considerable in importance, value, degree, amount, or extent". This is the definition to be used for "substantial" and its derived forms, such as "substantially", for the purposes of this patent application. In particular, for example, a radio circuit that is shielded from a substantial portion of ionizing radiation is a radio circuit that is able to operate with an acceptable level of reliability; while, in contrast, the same radio circuit, if exposed to the ionizing radiation without being shielded, would find its operation impaired. Also, for example, an antenna whose functionality is not substantially impaired by the presence of an object is an antenna whose characteristics might have been altered by the presence of the object; however, the altered characteristics are still adequate to provide the desired functionality for which the antenna was originally designed. For example, it is well known in the art that a cellphone's antenna is affected, sometimes adversely, by the presence of the hand of the cellphone user; but well-designed cellphones make adequate allowances for the possible presence of the hand, and, from the point of view of the user, the cellphone's functionality is not impaired.

To Transmit—For the purposes of this patent application, the infinitive "to transmit" and its inflected forms (e.g., "transmitter", "transmitting", "transmitted", "transmission", etc.) should be given the ordinary and customary meaning that the terms would have to a person of ordinary skill in the art at the time of the invention. In this patent application, the preposition "through" is used to indicate transmission by means of a supporting medium or channel, as in "transmitting through a network". In contrast, the preposition "over" is used to indicate reception from a supporting medium or channel, as in "receiving over a network". The reason for using different prepositions is to enhance clarity. Transmission of a radio-frequency signal requires a material medium as in transmission through a transmission line or through an electrical connection. Transmission of a radio signal through a radio channel occurs through air or vacuum and is accomplished with the use of an antenna.

When—For the purposes of this patent application, the word "when" is defined as "upon the occasion of".

What is claimed is:

1. A radio communicator for use in the presence of ionizing radiation, the radio communicator comprising:

an antenna comprising a first group of one or more metal sheets for achieving a desired antenna pattern;

a first radio circuit electrically connected to the antenna at a first input-output port; and a second group of one or more metal sheets for achieving additional shielding of the radio circuit;

wherein the metal sheets in the first group are arranged, relative to the first radio circuit, such that the first radio circuit is shielded from a substantial portion of the ionizing radiation;

wherein the metal sheets in the second group are arranged, relative to the antenna, to block an additional portion of the ionizing radiation not blocked by metal sheets in the first group; and wherein the second group is also arranged, relative to the antenna, such that the functionality of the antenna is not substantially impaired.

2. The radio communicator of claim 1 wherein the additional portion is at least half of the ionizing radiation not blocked by the first group.

3. The radio communicator of claim 2 further comprising a second radio circuit electrically connected to the antenna at a second input-output port;

wherein the metal sheets in the first group are arranged, relative to the second radio circuit, such that the second radio circuit is also shielded from a substantial portion of the ionizing radiation.

4. The radio communicator of claim 2 further comprising a dielectric material.

5. The radio communicator of claim 4 wherein the dielectric material blocks an additional portion of the ionizing radiation not blocked by metal sheets in the first group.

6. The apparatus of claim 2 wherein the radio circuit is a radio transceiver.

7. The radio communicator of claim 1 wherein the additional portion is at least 80% of the ionizing radiation not blocked by the at least one first metal sheet.

8. The radio communicator of claim 3 wherein the additional portion is at least 90% of the ionizing radiation not blocked by the at least one first metal sheet.

9. The radio communicator of claim 1 further comprising a second radio circuit electrically connected to the antenna at a second input-output port;

wherein the metal sheets in the first group are arranged, relative to the second radio circuit, such that the second radio circuit is also shielded from a substantial portion of the ionizing radiation.

10. The radio communicator of claim 1 further comprising a dielectric material.

11. The radio communicator of claim 10 wherein the dielectric material blocks an additional portion of the ionizing radiation not blocked by metal sheets in the first group.

12. The apparatus of claim 1 wherein the radio circuit is a radio transceiver.

* * * * *